US005086698A

United States Patent [19]

Wirz

[11] Patent Number: 5,086,698

[45] Date of Patent: Feb. 11, 1992

[54] DEVICE FOR SMOOTHING A SHEET ON AN IMPRESSION CYLINDER OF A SHEET-FED ROTARY PRINTING MACHINE

[75] Inventor: Arno Wirz, Bammental, Fed. Rep. of Germany

[73] Assignee: Heidelberger Druckmaschinen AG, Heidelberg, Fed. Rep. of Germany

[21] Appl. No.: 542,425

[22] Filed: Jun. 22, 1990

[30] Foreign Application Priority Data

Jun. 24, 1989 [DE] Fed. Rep. of Germany ..... 3920730

[51] Int. Cl.[5] ..... B41F 1/30

[52] U.S. Cl. ..... 101/409; 271/195; 226/95

[58] Field of Search ..... 101/409, 415.1, 424.1, 101/378, 142; 271/276, 194, 195, 90; 226/95

[56] References Cited

U.S. PATENT DOCUMENTS

| | | | |
|---|---|---|---|
| 2,764,408 | 9/1956 | Weiler | 271/162 |
| 4,060,238 | 11/1977 | Simeth . | |
| 4,395,949 | 8/1983 | Jeschke | 101/424.1 |

FOREIGN PATENT DOCUMENTS

| | | | |
|---|---|---|---|
| 0016938 | 10/1980 | European Pat. Off. . | |
| 0306684 | 3/1989 | European Pat. Off. . | |
| 83644 | 10/1895 | Fed. Rep. of Germany . | |
| 171175 | 5/1906 | Fed. Rep. of Germany . | |
| 583479 | 8/1933 | Fed. Rep. of Germany | 101/424.1 |
| 1061798 | 12/1959 | Fed. Rep. of Germany . | |
| 57345 | 4/1970 | Fed. Rep. of Germany | 101/409 |
| 0240705 | 11/1986 | Fed. Rep. of Germany | 101/424.1 |
| 3635089 | 6/1987 | Fed. Rep. of Germany . | |
| 3835266 | 5/1989 | Fed. Rep. of Germany . | |
| 475090 | 8/1969 | Switzerland | 101/424.1 |

*Primary Examiner*—Eugene H. Eickholt

*Attorney, Agent, or Firm*—Herbert L. Lerner; Laurence A. Greenberg

[57] ABSTRACT

A device for smoothly applying a sheet for printing onto an impression cylinder upstream of a printing gap of a sheet-fed rotary offset printing machine in travel direction of the sheet through the printing machine and including at least one jet nozzle capable of being directed towards the circumference of the impression cylinder for pressing the sheet by blowing air force against the circumference, comprising drive means for swingingly reciprocating the jet nozzle in travel direction of the sheet during an operating cycle of the printing machine, the jet nozzle being mounted at a spaced distance and upstream from a printing gap and being swingable in a pendular manner about a pendulum axis extending parallel to an axis of the impression cylinder, the jet nozzle being couplable with the drive means.

6 Claims, 3 Drawing Sheets

DEVICE FOR SMOOTHING A SHEET ON AN IMPRESSION CYLINDER OF A SHEET-FED ROTARY PRINTING MACHINE

The invention relates to a device for smoothing printed sheets on an impression cylinder upstream of a printing gap of a sheet-fed rotary printing machine in travel direction of the sheet through the printing machine and including at least one jet nozzle capable of being directed towards the circumference of the impression cylinder for pressing the sheet by blowing-air force against the circumference.

European Patent 0 306 684 describes a device for smoothing sheets in a multicolor sheet-fed rotary printing machine which is positioned downstream from the printing gap above the impression cylinder of a printing unit and has jet fingers which are disposed so as to be fixed against torsion on a jet-finger tube at uniform spacing from one another over the width of the impression cylinder, the jet fingers having a lower region formed with air discharge openings and an air discharge surface matching the outer contour of the impression cylinder and extending to a tangential point between a downstream sheet-turning cylinder and the impression cylinder. The jet fingers, together with the finger tube, are mounted on fixed machine parts and, by means of an adjusting device, can be lifted up from the direction of the tangential point, during first form printing, and can be lowered in the direction of the tangential point, during perfector printing. This device is thus effective upstream of the printing gap, in order to apply the sheet printed in first form smoothly, through the action of blowing air, onto the closed surface of the impression cylinder in the region upstream of the tangential point between a sheet-turning cylinder and the impression cylinder upstream therefrom, until the end of the sheet is gripped by the sheet-turning cylinder. According to this publication, however, axially parallel jet strips disposed upstream of the printing zone above air impression cylinder, so that the sheet is smoothly applied to the surface of the impression cylinder by means of blown air, are in the state of the art.

A device with a jet tube and nozzles thereon, which are adjustable in the direction of the jet, to blow a sheet which is to be printed against a feeder drum in a multicolor sheet-fed rotary printing machine has become known heretofore from German Published Non-Prosecuted Application (DE-OS) 25 50 721. This device, however, is not intended to apply the sheet to be printed smoothly at the circumference of the impression cylinder.

The control of blown air for devices according to the state of the art has become known heretofore from German Published Non-Prosecuted Application (DE-OS) 36 35 089. Finally, German Patent 1 061 798 describes smoothing brushes arranged upstream of the printing gap and acting towards the circumference of the impression cylinder, the smoothing brushes being lifted when the leading edge of the sheet passes, and applying the sheet smoothly against the impression cylinder after the leading edge of the sheet has travelled past.

It is accordingly an object of the invention to provide a device for smoothing a sheet at the circumference of the impression cylinder upstream of the printing gap of a sheet-fed rotary printing machine which is improved so that a reliable, close-fitting application of the sheet to be printed on the impression cylinder is effected regardless of the type of paper of the sheet to be printed, before the latter enters the printing gap, as well as so that a greater certainty that a print will be produced without doubling or smearing, even at very high printing speeds.

With the foregoing and other objects in view, there is provided, in accordance with the invention, a device for smoothly applying a sheet for printing onto an impression cylinder upstream of a printing gap of a sheet-fed rotary offset printing machine in travel direction of the sheet through the printing machine and including at least one jet nozzle capable of being directed towards the circumference of the impression cylinder for pressing the sheet by blowing air force against the circumference, comprising drive means for swingingly reciprocating the jet nozzle in travel direction of the sheet during an operating cycle of the printing machine, the jet nozzle being mounted at a spaced distance and upstream from a printing gap and being swingable in a pendular manner about a pendulum axis extending parallel to an axis of the impression cylinder, the jet nozzle being couplable with the drive means.

These structural features increase the possibilities for contactless action upon the sheet to be printed, for the purpose of achieving a reliable and close-fitting application on the impression cylinder before the sheet to be printed enters the printing gap, and improve the possibilities of exerting any influence as compared with heretofore-known devices.

In accordance with another feature of the invention, the jet nozzle is a sword nozzle having a nozzle opening extending over a major part of the width of the impression cylinder.

The swivel angle with air outlet from the sword nozzle, depending upon the type of paper to be printed, can be brought more-or-less close to the normal through the swivelling axis of the jet nozzle on the circumference of the impression cylinder. This is closer for stiffer types of paper than for thinner types. In the opposite direction, when air is discharged, the sword nozzle swivels, if necessary or desirable, past the tangent to the impression cylinder through the swivelling axis of the sword nozzle. Thus a swivelling position can be achieved in which no air jet is effective any longer on the sheet to be printed. When the leading edge of the sheet travels past, no blowing effect occurs on the sheet, so that underblowing of the sheet is prevented. This can be achieved, when the leading edge of the sheet travels past, by means of the sword nozzle being swivelled over the tangent to the impression cylinder through the swivelling axis of the sword nozzle, or by means of an air control device interrupting the blown air when the leading edge of the sheet travels past.

A lever drive with a cam control, for example, is suitable for the drive of the swinging pendulum movement of the sword nozzle in the working cycle of the machine.

If necessary or desirable, several swingingly moved smoothing nozzles having the hereinafore-described structural features can be positioned one behind the other in circumferential direction of the impression cylinder. It is also possible to arrange a swinging smoothing nozzle downstream of or upstream of the printing gap, in connection with a jet nozzle which is adjustable in the direction of the air jet, if necessary or desirable, but which is fixed in position during operation.

In accordance with an added feature of the invention, the jet nozzle is swivellable from a position thereof wherein it has a blowing direction opposite to the direction of travel of the printed sheet into a position thereof beyond a tangent formed by its pendulum axis with the circumference of the impression cylinder.

In accordance with an additional feature of the invention, the jet nozzle is swingingly drivable by the drive means in the travel direction of the printed sheet into a position substantially perpendicular to the circumference of the impression cylinder.

In accordance with again another feature of the invention, the air blower from the jet nozzle is controllable and adjustable during the operating cycle of the printing machine by means of the swinging movement of the jet nozzle.

In accordance with again a further feature of the invention, the jet nozzle is fixable in a swivelled-back rest position.

In accordance with a concomitant feature of the invention, there is provided at least another jet nozzle disposed in fixed position and directed towards the circumference of the impression cylinder, the other jet nozzle having a controllable air jet.

Other features which are considered as characteristic for the invention are set forth in the appended claims.

Although the invention is illustrated and described herein as embodied in a device for smoothing a sheet on an impression cylinder of a sheet-fed rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
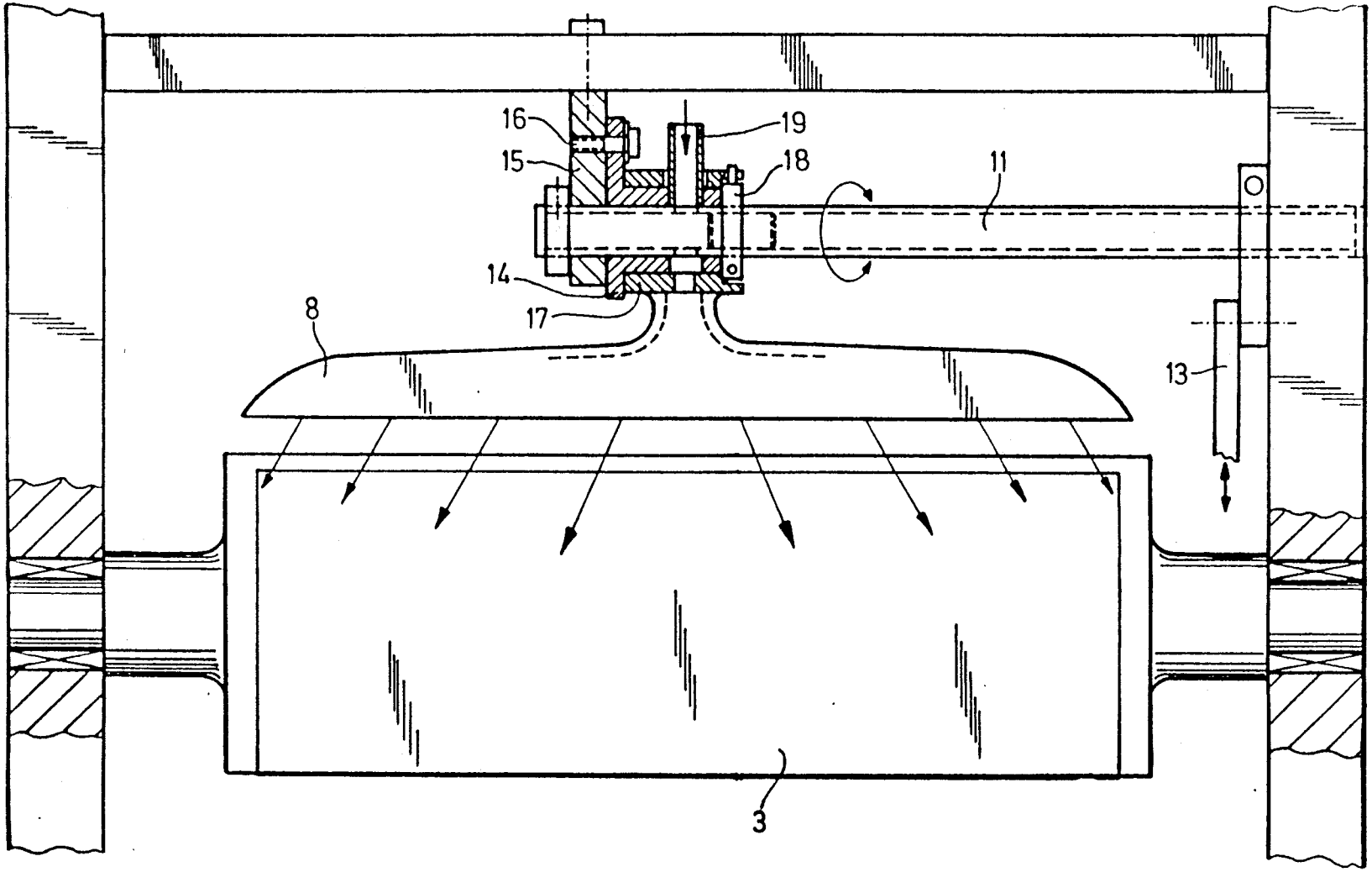
FIG. 2 is an elevational view, partly in section, of a smoothing nozzle disposed across the direction of travel of a print sheet, the view being much enlarged with respect to that of FIG. 1.
Figure 3:
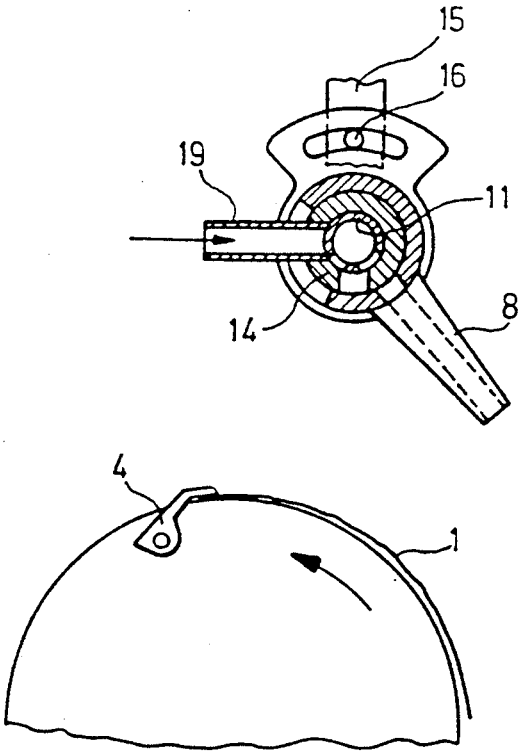
Figure 4:
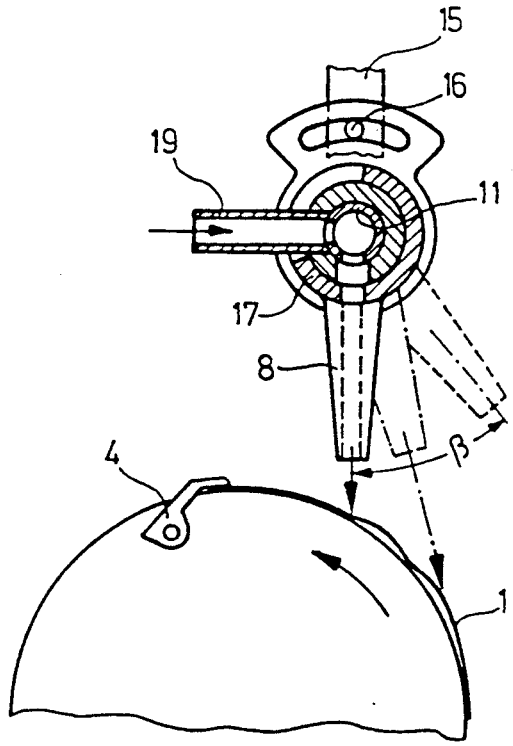
Figure 5:
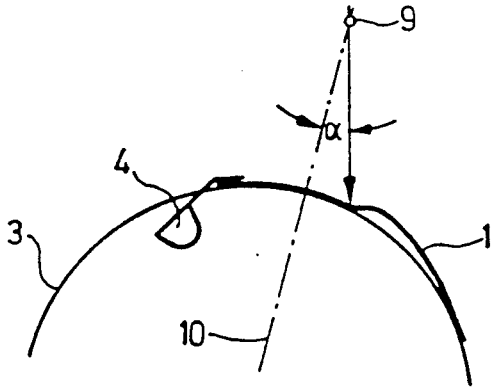
Figure 6:
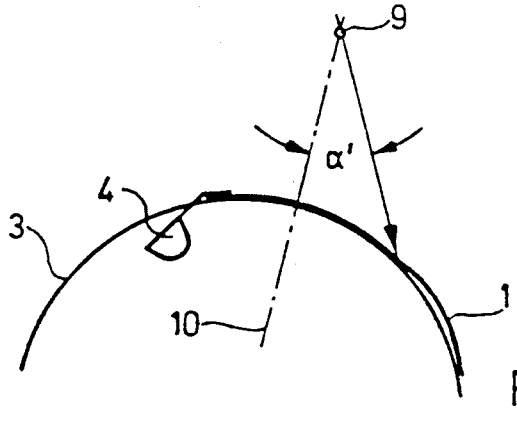

FIGS. 3 and 4 are respective cross-sectional views of FIG. 2 in two different adjustable end positions thereof; and FIGS. 5 and 6 are diagrammatic views similar to parts of FIGS. 3 and 4 and depicting different setting angles for the application of an air jet which depend upon the quality of the paper to be printed.

Figure 1:
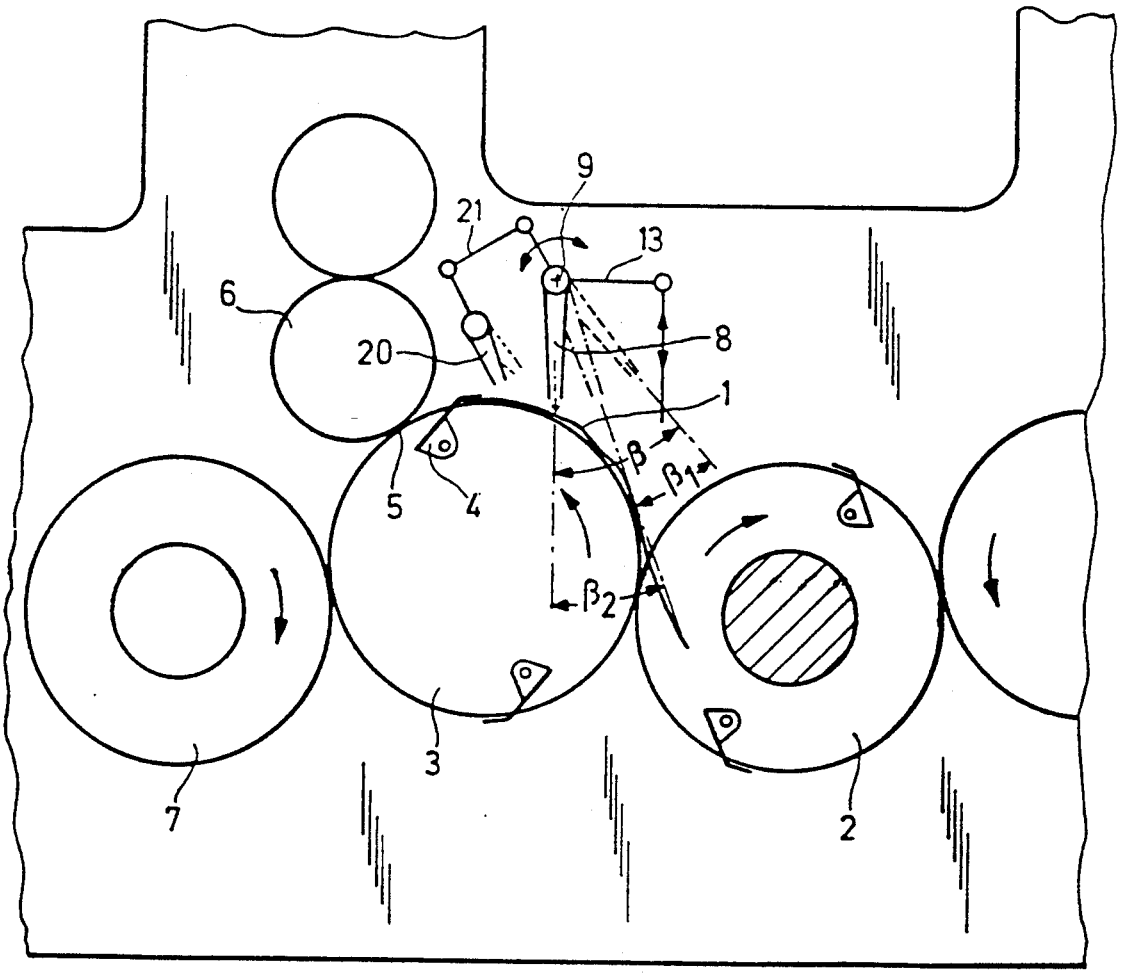
FIG. 1 is a diagrammatic side elevational view of a printing unit incorporating a device for smoothing a sheet on an impression cylinder thereof, in accordance with the invention.

Referring now to the drawing and, first, particularly to FIG. 1 thereof, there is shown diagrammatically therein a side elevational view of a printing unit of a multi-color sheet-fed rotary printing machine. A printed sheet 1, accepted from a printing unit located upstream thereto in the travel direction of the sheet, is transferred by a transfer drum 2 to an impression cylinder 3 of a printing unit downstream therefrom. Sheet grippers 4 grip the printed sheet 1 at a tangential point between the transfer drum 2 and the impression cylinder 3 and draw the printed sheet 1 through a printing gap 5 between the impression cylinder 3 and a rubber blanket cylinder 6. Downstream from the printing gap 5, the printed sheet 1 is fed to another transfer drum 7, which surrenders the printed sheet 1 to another printing unit.

In order to achieve a secure and close-fitting application of the printed sheet 1 to the circumference of the impression cylinder 3, a jet or blowing nozzle 8 is directed towards the circumference of the impression cylinder 3 at a given spaced distance from in front or upstream of the printing gap 5. The nozzle 8 is mounted so as to be swingable about a pendulum axis 9, and is couplable to a drive which reciprocates the jet nozzle 8 swingingly in the direction of travel of the sheet during the operation cycle of the printing machine. It is particularly advantageous for the jet nozzle 8 to be constructed as a sword-type nozzle corresponding to the representation thereof in FIG. 2, the nozzle opening of which extends at least over a considerable part of the width of the impression cylinder 3, and preferably over the entire width thereof. The angular range for the swinging movement of the jet nozzle 8 is adjustable and in fact, so that both a setting angle $\alpha$ and $\alpha'$, respectively (FIGS. 5 and 6) of the jet direction with regard to the normal 10 through the pendulum axis 9 on the circumference of the impression cylinder 3, as well as a swivel angle $\beta$ (FIGS. 1 and 4) are adjustable.

For this purpose, the jet nozzle 8 is fastened to a tube 11 so as to be adjustable in the direction of the circumference thereof, the tube 11 being mounted in the frame 12 of the machine so that it can be swung pendulously about the longitudinal axis thereof. A lever train or transmission 13 with a cam control or the like is suitable for the drive of the swinging or pendular movement of the jet nozzle 8, and is provided in the case of the illustrated embodiment. By means of a tube-shaped housing 17, the jet nozzle 8 is shaped onto a casing of a valve adjusting ring 14, which is adjustable with respect to a frame part 15 by means of a screw 16. The valve adjusting ring 14 is guided laterally by an entrainer 18 (FIG. 2). A radially directed connection 19 for an air conduit (which is not shown in the drawing) extends into the housing 17 and is fastened at its inner end to the valve adjusting ring 14. For purposes of adjustment, this connection is moveable radially in a range corresponding to the range of the angle of adjustment. After loosening the screw 16 and the entrainer 18, an adjustment can be performed for changing the setting or adjustment angle $\alpha$ with respect to the normals 10. The swivel angle $\beta$ is adjusted by the lever train or transmission 13 in the selected embodiment of the invention. The air control for the jet nozzle 8 is achieved by covering radial openings in the tube 11 with the inner end of the connection 19 and a passage in the housing 17 to the jet nozzle 8, respectively.

In the smallest adjustment angle $\alpha$, the air jet from the jet nozzle 8 is directable almost perpendicularly or vertically onto the surface of the impression cylinder 3. The center of the pendulous movements of the jet nozzle 8 lies somewhat on a tangent to the impression cylinder 3 passing through the pendulum axis 9, so that the jet nozzle 8 moves in a swinging manner out of a swing-back zero position without air feed, as is represented in FIG. 3 by solid lines, and in FIG. 4 by broken lines, to a forward position, which is represented in FIG. 4 by solid lines. This offers the advantage that, in particular, when cardboard sheets are processed in machines with diverting or looping drums without shell plates or sheetmetal casings, an air jet can be directed, in the swivel angle region $\beta_1$, onto the trailing end of the sheet, in order to force the latter away from the shaft of the diverting drum 2, and thereby preventing blotting phenomena. In the forward swivel angle region $\beta_2$, the air from the jet nozzle 8 forces the sheet against the circumference of the impression cylinder 3. The swivelling movement of the jet nozzle 8 thus takes place advantageously opposite to the direction of travel of the sheet 1 on the circumference of the impression cylinder 3.

To avoid underblowing the printed sheet, the air jet from the jet nozzle 8 can be interrupted when the leading edge of the printed sheet 1 travels by, or the jet nozzle 8 may be in a swivelling position which prevents underblowing of the printed sheet at its leading edge as the sheet travels by.

The jet nozzle 8 is preferably able to be fixed, or is decouplable from the drive, in the swivelled-back final position thereof; as is represented, for example, by broken lines in FIG. 4, in order to permit switching off if the jet nozzle 8 is not required for printing processes.

Instead of the hereinafore-described control of the air feed to the jet nozzle 8 by means of the pendular movement of the jet nozzle 8 itself, other conventional devices can be used.

In FIG. 1, a diagrammatically illustrated possibility for positioning another pendulum nozzle 20 is presented, which can be coupled to the tube 11 or the lever train or transmission 13 by means of another lever train or transmission 21. In this way, the swing angle of the nozzle 20 can deviate from the swing angle of the nozzle 8 and, likewise, the adjusted setting angle can be different. Instead of a pendulum nozzle 20, a nozzle which can be adjusted but which is nevertheless fixed during operation can also be provided.

The foregoing is a description corresponding in substance to German Application P 39 20 730.7, dated June 24, 1989, the International priority of which is being claimed for the instant application, and which is hereby made part of this application. Any material discrepancies between the foregoing specification and the aforementioned corresponding German application are to be resolved in favor of the latter.

I claim:

1. Device for smoothly applying a sheet for printing onto an impression cylinder upstream of a printing gap of a sheet-fed rotary offset printing machine in travel direction of the sheet through the printing machine and including at least one jet nozzle capable of being directed towards the circumference of the impression cylinder for pressing the sheet by blowing air force against the circumference, comprising drive means for swingingly reciprocating the jet nozzle in travel direction of the sheet during an operating cycle of the printing machine, the jet nozzle being mounted at a spaced distance and upstream from a printing gap and being swingable in a pendular manner about a pendulum axis extending parallel to an axis of the impression cylinder, the jet nozzle being couplable having a nozzle opening extending over a major part of the width of the impression cylinder.

2. Device according to claim 1, wherein the jet nozzle is swivellable from a position thereof wherein it has a blowing direction opposite to the direction of travel of the printed sheet into a position thereof beyond a tangent formed by its pendulum axis with the circumference of the impression cylinder.

3. Device according to claim 1, wherein the jet nozzle is swingingly drivable by said drive means in the travel direction of the printed sheet into a position substantially perpendicular to the circumference of the impression cylinder.

4. Device according to claim 1, wherein the air blown from the jet nozzle is controllable and adjustable during the operating cycle of the printing machine by means of the swinging movement of the jet nozzle.

5. Device according to claim 1, wherein the jet nozzle is fixable in a swivelled-back rest position.

6. Device according to claim 1, including at least another jet nozzle disposed in fixed position and directed towards the circumference of the impression cylinder, said other jet nozzle having a controllable air jet.

* * * * *